US008308081B1

(12) United States Patent
Goettl

(10) Patent No.: US 8,308,081 B1
(45) **Date of Patent: *Nov. 13, 2012**

(54) CAM OPERATED SWIMMING POOL CLEANING NOZZLE

(75) Inventor: John M. Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 109 days.

This patent is subject to a terminal disclaimer.

(21) Appl. No.: 12/912,691

(22) Filed: Oct. 26, 2010

Related U.S. Application Data

(60) Continuation-in-part of application No. 11/924,400, filed on Oct. 25, 2007, now Pat. No. 7,979,924, which is a continuation-in-part of application No. 10/930,494, filed on Aug. 31, 2004, now Pat. No. 7,578,010, which is a division of application No. 10/406,333, filed on Apr. 3, 2003, now Pat. No. 6,848,124, said application No. 12/912,691 is a continuation-in-part of application No. 12/100,135, filed on Apr. 9, 2008, now Pat. No. 7,819,338.

(51) Int. Cl.

| | |
|---|---|
| ***B05B 15/10*** | (2006.01) |
| ***E04H 4/16*** | (2006.01) |
| ***E04H 4/14*** | (2006.01) |
| ***E04H 4/00*** | (2006.01) |

(52) U.S. Cl. ..... 239/205; 239/204; 4/490

(58) Field of Classification Search ..... 239/200–206, 239/208, 282; 4/490, 492

See application file for complete search history.

(56) References Cited

U.S. PATENT DOCUMENTS

| | | | |
|---|---|---|---|
| 1,821,579 | A | 9/1931 | Rader |
| 1,964,269 | A | 6/1934 | Munz |
| 2,209,961 | A | 8/1940 | De Lacy-Mulhall |
| 2,214,852 | A | 9/1940 | De Lacy-Mulhall |
| 3,237,866 | A | 3/1966 | Lovell |
| 3,247,968 | A | 4/1966 | Miller |
| 3,247,969 | A | 4/1966 | Miller |
| 3,408,006 | A | 10/1968 | Stanwood |
| 3,449,772 | A | 6/1969 | Werner |
| 3,486,623 | A | 12/1969 | Bosico |
| 3,506,489 | A | 4/1970 | Baker |
| 3,515,351 | A | 6/1970 | Costa |
| 3,521,304 | A | 7/1970 | Ghiz |
| 3,675,252 | A | 7/1972 | Ghiz |
| 3,765,608 | A | 10/1973 | Lockwood |
| 3,955,764 | A | 5/1976 | Phaup |
| 4,114,206 | A | 9/1978 | Franc |
| 4,188,673 | A | 2/1980 | Carter |
| 4,193,870 | A | 3/1980 | Goodin |
| 4,195,371 | A | 4/1980 | Goodin |
| 4,200,230 | A | 4/1980 | Gould |

(Continued)

*Primary Examiner* — Darren W Gorman
(74) *Attorney, Agent, or Firm* — Booth Udall, PLC

(57) ABSTRACT

Methods of cleaning a swimming pool using a swimming pool cleaning head. A first method may include intermittently raising a nozzle head under water and ejecting a stream of water under water, incrementally rotating the nozzle head in a clockwise direction, retracting the nozzle head, sliding a cam reverser, and reversing the direction of rotation of the nozzle head with the cam reverser to counterclockwise. A second method may include rotating a stem by sliding at least one pin coupled to the stem through at least one channel in a cam, the stem configured to release a stream of water under water in a swimming pool. The method may further include reversing the direction of rotation of the stem by sliding a slidable section of the cam with the at least one pin.

18 Claims, 11 Drawing Sheets

U.S. PATENT DOCUMENTS

| | | | | |
|---|---|---|---|---|
| 4,202,499 | A | 5/1980 | Mathews | |
| 4,212,088 | A | 7/1980 | Goettl et al. | |
| 4,271,541 | A | 6/1981 | Mathews | |
| 4,276,163 | A | 6/1981 | Gordon | |
| 4,322,860 | A | 4/1982 | Gould | |
| 4,347,979 | A | 9/1982 | Mathews | |
| 4,371,994 | A | 2/1983 | Mathews | |
| 4,391,005 | A | 7/1983 | Goettl | |
| 4,462,546 | A | 7/1984 | Pitman | |
| 4,466,142 | A | 8/1984 | Gould | |
| 4,471,908 | A | 9/1984 | Hunter | |
| 4,520,514 | A | 6/1985 | Johnson | |
| 4,568,024 | A | 2/1986 | Hunter | |
| 4,592,379 | A | 6/1986 | Goettl | |
| 4,939,797 | A | 7/1990 | Goettl | |
| 5,048,758 | A | 9/1991 | Jackerson | |
| 5,135,579 | A | 8/1992 | Goettl | |
| 5,251,343 | A | 10/1993 | Goettl | |
| 5,333,788 | A | 8/1994 | Hadar | |
| 5,826,797 | A | 10/1998 | Kah, III | |
| 6,029,907 | A | 2/2000 | McKenzie | |
| 6,085,995 | A | 7/2000 | Kah, Jr. et al. | |
| 6,182,909 | B1 | 2/2001 | Kah, Jr. et al. | |
| 6,237,862 | B1 | 5/2001 | Kah, III et al. | |
| 6,301,723 | B1 | 10/2001 | Goettl | |
| 6,367,098 | B1 | 4/2002 | Barnes | |
| 6,393,629 | B1 | 5/2002 | Barnes et al. | |
| 6,438,766 | B1 | 8/2002 | Capdevila Arnau et al. | |
| 6,848,124 | B2 * | 2/2005 | Goettl | 4/490 |
| 6,971,588 | B1 | 12/2005 | Tarr et al. | |
| 7,708,212 | B1 | 5/2010 | Conn | |
| 2004/0194201 | A1 | 10/2004 | Goettl | |
| 2004/0217210 | A1 | 11/2004 | Goettl et al. | |
| 2005/0023373 | A1 * | 2/2005 | Goettl | 239/200 |
| 2005/0167520 | A1 * | 8/2005 | Goettl et al. | 239/11 |

* cited by examiner

CAM OPERATED SWIMMING POOL CLEANING NOZZLE

CROSS REFERENCE TO RELATED APPLICATIONS

This application is a continuation-in-part application of the earlier U.S. Utility Application to Goettl entitled "Cam Operated Swimming Pool Cleaning Nozzle," application Ser. No. 11/924,400, filed Oct. 25, 2007, now pending, which is a continuation-in-part application of the earlier U.S. Utility Patent Application to Goettl entitled "Method for Operating a Pop-Up Cleaning Nozzle for a Pool or Spa," application Ser. No. 10/930,494, filed Aug. 31, 2004, now pending, which is a divisional application of a patent application to Goettl entitled "Cam Operated Pop-Up Swimming Pool Cleaning Nozzle filed Apr. 3, 2003, application Ser. No. 10/406,333, now U.S. Pat. No. 6,848,124, issued Feb. 1, 2005, the disclosures of which are hereby incorporated entirely herein by reference. This application is also a continuation-in-part application of the earlier U.S. Utility Application to Goettl entitled "Cam Operated Swimming Pool Cleaning Nozzle," application Ser. No. 12/100,135, filed Apr. 9, 2008, now pending, and issuing as U.S. Pat. No. 7,819,338 on Oct. 26, 2010, the disclosure of which is hereby incorporated entirely herein by reference.

BACKGROUND

1. Technical Field

Aspects of this document relate generally to cleaning nozzles for swimming pools.

2. Background Art

Conventional cleaning nozzles for swimming pools utilize water pressure generated by a pool pump to direct a stream of water across a surface of the pool to entrain and move contaminants from the surface toward a drain. Many conventional cleaning nozzles "pop up" from a surface of a pool as the heads, normally level with the surface, are extended under the influence of water pressure from the pump. When the water pressure from the pump ends, the heads retract downward until level with the surface, conventionally in response to bias from a spring element contained within the cleaning nozzle.

SUMMARY

Implementations of a swimming pool cleaning head may utilize methods of cleaning a swimming pool. According to a first aspect, a swimming pool cleaning head assembly may comprise a cam housing, a cam assembly removably coupled to the cam housing, the cam assembly comprising an upper section, a lower section and a rotatable section slidably disposed between the upper section and the lower section and rotatable between a first extent and a second extent, the cam assembly comprising a plurality of saw tooth members, and a stem extending through the cam assembly, the stem comprising a pin slidably engaged with the plurality of saw tooth members, the pin configured to incrementally rotate the stem clockwise in intermittent contact with the saw tooth members and the rotatable section of the cam assembly during vertical translation of the stem through water pressure force, and slidably rotate the rotatable section of the cam assembly from its first extent to its second extent, wherein the cam assembly is configured to automatically reverse the incremental rotation of the stem to counterclockwise when the rotatable section of the cam assembly is rotated to its second extent.

Particular implementations of a swimming pool cleaning head assembly may comprise one or more of the following features. The upper section and the lower section of the cam assembly may be coupled in a positionally fixed manner such that they do not rotate with respect to each other. The upper section and the lower section of the cam assembly may be coupled in a positionally fixed manner through a locking ring comprising a plurality of lugs mechanically engaged with the cam housing. The locking ring may further comprise an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction. A cap ring may be removably coupled to the cam housing over the locking ring, the cam housing may further comprise a locking arm extending from a side of the cam housing, flexibly engaging the cap ring and resisting rotational movement of the cap ring in one direction. A plurality of ridges may be included on an annular surface of the cam housing, the lower section of the cam assembly comprising a plurality of mating grooves on an annular surface of the lower section of the cam assembly, wherein coupling the plurality of ridges of the cam housing with the plurality of grooves of the cam assembly resists rotational movement of the cam assembly within the cam housing.

According to another aspect, a swimming pool cleaning head assembly may comprise a cam housing comprising a cam assembly within the cam housing, the cam assembly comprising an upper cam portion with a first plurality of pin guides, a lower cam portion with a second plurality of pin guides, the upper cam portion and the lower cam portion coupled together in a fixed positional relationship, and a slidably rotatable portion at least part of which is positioned between the upper cam portion and the lower cam portion, the slidably rotatable portion comprising a third plurality of pin guides slidably mounted between the first plurality of pin guides and the second plurality of pin guides, the slidably rotatable portion slidable from a first extent to a second extent, and a stem extending through the cam assembly, the stem comprising a pin slidably engaged with the cam assembly between the first plurality of pin guides and the second plurality of pin guides, wherein rotation of the slidably rotatable portion alters a pin path through the first and second pluralities of pin guides and rotation of the slidably rotatable portion from the first extent to the second extent reverses a direction of travel for the pin along the pin path through the first and second pluralities of pin guides.

Particular implementations of a swimming pool cleaning head assembly may comprise one or more of the following features. The first and second pluralities of pin guides may comprise first and second pluralities of saw tooth members. The pin may be configured to incrementally rotate the stem clockwise in intermittent contact with the pin guides and the slidably rotatable section of the cam assembly during vertical translation of the stem through water pressure force applied to the stem, and slidably rotate the slidably rotatable section of the cam assembly from its first extent to its second extent. A plurality of ridges may be included on an annular surface of the cam housing and a plurality of grooves may be included an annular surface of the cam assembly that mate with the plurality of ridges on the cam housing when removably coupled thereto and resist rotational movement of the cam assembly within the cam housing; wherein the cam assembly is configured to both incrementally rotate the stem clockwise as the stem extends from the housing under water pressure force and to automatically reverse the incremental rotation of the stem counterclockwise. A cap ring may be removably coupled to the cam housing over a locking ring engaged with the cam housing, the cam housing may further comprise a locking arm extending from a side of the cam housing, flexibly engaging the cap ring and preventing rotational movement of the cap ring in one direction. A locking ring may be mechanically engaged with the cam housing, the locking ring may further comprise an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction.

According to yet another aspect, a swimming pool cleaning head may comprise a cleaning head assembly having a housing comprising a cam assembly having an upper section, a lower section, and a slidable section rotatably disposed between the upper section and the lower section, and a stem comprising an outlet configured to eject an intermittent stream of water under water therethrough under water pressure force, the stem extending through the cam assembly, the stem comprising at least one pin slidably engaged within the cam assembly.

Particular implementations of a swimming pool cleaning head assembly may comprise one or more of the following features. The pin may be configured to intermittently engage with a saw tooth member comprised within the upper section and slidable section and to slidably rotate the slidable section while the stem is under water pressure force. The slidable section may comprise a channel in communication with an angled channel comprised in the upper section, and the slidable section is configured to accommodate through slidable rotation, the pin, as it enters the channel. A locking ring may be mechanically engaged with the cam housing, the locking ring may further comprise an annular surface comprising at least one angled projection extending toward a cap ring rotationally coupled to the cam housing, the cap ring may comprise raised projections on an annular surface extending toward the locking ring, wherein rotation of the cap ring in relation to the locking ring causes the raised projections on the cap ring to engage the angled projections on the locking ring to resist rotational movement of the cap ring in one direction. A plurality of ridges may be included on an annular surface of the cam housing and a plurality of grooves may be included on an annular surface of the cam assembly that mate with the plurality of ridges on the cam housing when removably coupled thereto and resist rotational movement of the cam assembly within the cam housing; wherein the cam assembly is configured to both incrementally rotate the stem clockwise as the stem extends from the housing under water pressure force and to automatically reverse the incremental rotation of the stem counterclockwise. A cap ring may be removably coupled to the cam housing over a locking ring engaged with the cam housing, the cam housing may further comprise a locking arm extending from a side of the cam housing, flexibly engaging the cap ring and preventing rotational movement of the cap ring in one direction.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended nozzle assembly and/or assembly procedures for a nozzle assembly will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such nozzle assemblies and implementing components, consistent with the intended operation.

Figure 1:
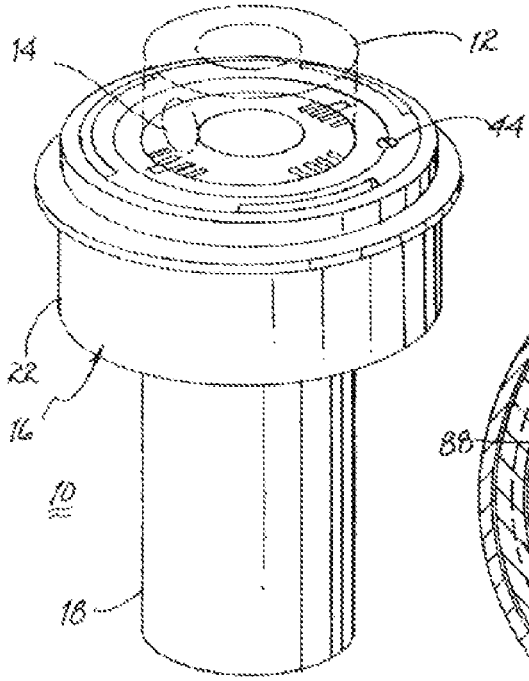
FIG. 1 is an perspective view of a nozzle assembly.

A particular implementation of a recessed incrementally rotating nozzle assembly 10 for use in swimming pools and the like is illustrated in FIG. 1. In the retracted position, the upper surface of the nozzle assembly is substantially flush with the adjacent swimming pool surface. The extended position of nozzle housing 12 is shown in dashed lines and includes an outlet 14 through which a stream of water is ejected. Body 16 includes a hollow cylinder 18 for attachment to the interior of a conduit 20 (see FIG. 2) periodically supplying water under pressure to the nozzle assembly.

A diametrically enlarged section 22 is supported by and extends from cylinder 18. Referring to the implementation illustrated in FIG. 2, cylinder 18 includes a plurality of lugs 30 disposed on the interior surface thereof. A retainer 32, for retaining the operative elements of the nozzle assembly within body 16, includes a plurality of lugs 34 extending radially outwardly for locking engagement with lugs 30 upon passing the lugs 34 of the retainer 32 axially past the lugs 30 of cylinder 18 and rotating the retainer 32 to bring about locking engagement. In particular implementations, an O-ring 36 or the like may be disposed between the retainer and the cylinder to prevent water flow therebetween.

A cam ring 40 is rotatably lodged within radially expanded section 42 of retainer 32. Rotation of the cam ring 40 relative to section 42 is prevented by a screw 44, or the like, threadedly inserted between cam ring 40 and section 42. A plurality of downwardly pointing saw tooth members 46, or other pin guides 46, are disposed along the upper part of cam ring 40. A similar plurality of upwardly pointing saw tooth members 48, or other pin guides 48, are disposed along cam ring 40. A ring-like cam reverser 50 is slidably lodged adjacent cam ring 40 and is circumferentially slidably captured between saw tooth members 46, 48. An arm 52 extends downwardly and radially inwardly from the cam reverser 50. Further details relating to the structure and operation of implementations of the saw tooth members 46, 48, the cam reverser 50, and the arm 52 will be described later in greater detail.

A sleeve 60 is vertically translatable upwardly within cylinder 18 in response to water pressure present within conduit 20. Such vertical translation is resisted by a coil spring 62 bearing against an annular lip 64 of the sleeve 60, a lip 81 associated with a pattern cam 80, and the retainer 32. Nozzle housing 12 is supported upon sleeve 60 and defines an outlet 14 through which a stream of water is ejected upon upward translation of the sleeve 60. In the absence of water pressure within conduit 20, coil spring 62 will draw sleeve 60 and nozzle assembly 12 downwardly to the retracted position illustrated in FIG. 2. A pair of diametrically opposed pins 70,72 extend radially outwardly from nozzle housing 12 for sliding engagement with sets of saw tooth members 46, 48, which engagement causes nozzle housing 12 to rotate incrementally each time it is extended and refracted under the influence of water pressure, as will be described in further detail below.

A pattern cam 80 is positionally fixed upon radially extending shoulder 38 formed as part of retainer 32. It includes lip 81 extending around the interior edge of shoulder 38. The pattern cam 80 is configured to determine the angular extent of reciprocating rotation of nozzle housing 12. Particular implementations of a pattern cam 80 may define an angle of reciprocating rotation of 180 degrees or ninety degrees; however, for implementations utilized in specific locations within a swimming pool, a greater or lesser angle of reciprocating rotation may be selected to ensure washing/scrubbing of the swimming pool surface of interest.

Figure 3:
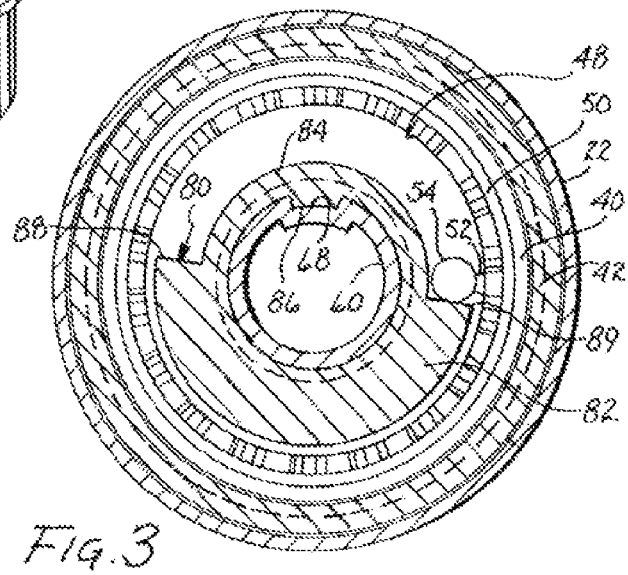
FIG. 3 is a cross sectional view taken along lines 3-3 shown in FIG. 2.
Figures 6, 6A:
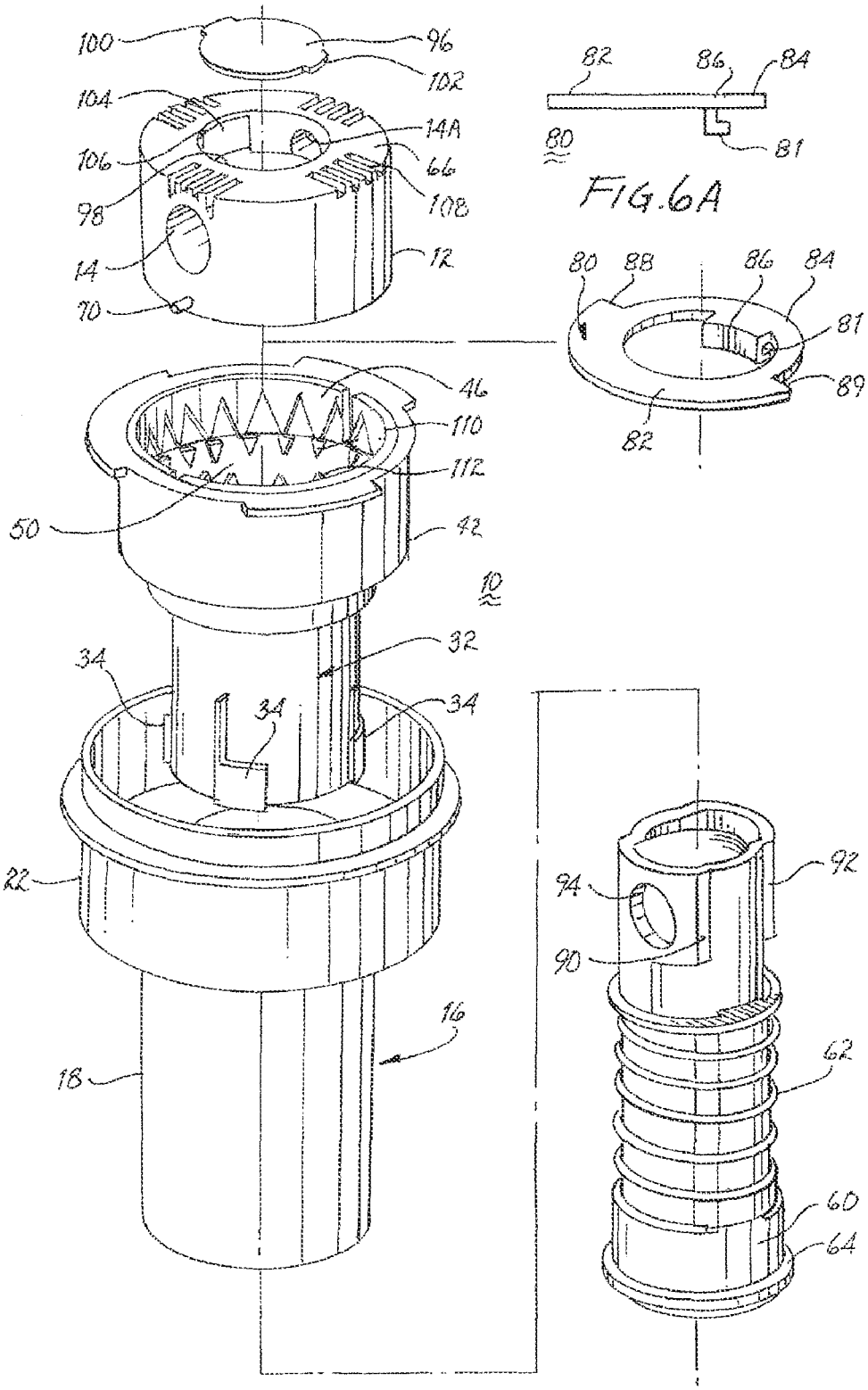
FIG. 6 is an exploded view of a nozzle assembly.
FIG. 6A is a side view of the pattern come shown in FIG. 6.

Referring to FIGS. 3, 6 and 6A, an implementation of a pattern cam 80 is illustrated. Sleeve 60 includes a keyway 68 to serve in the manner of an index. Pattern cam 80 includes an annular arc 84 extending from semi-circular disc 82, the combination of which surrounds sleeve 60. Annular arc 84 includes a key 86 mating with keyway 68 of sleeve 60; thereby, the pattern cam 80 is indexed with the sleeve 60 and will rotate commensurate with nozzle housing 12, also fixedly attached to the sleeve. Arm 52 is terminated by a flat roundel 54 disposed in the horizontal plane of disc 82. As sleeve 60 rotates in response to pins 70, 72 sequentially contacting saw tooth members 46, 48, pattern cam 80 will rotate commensurately. When one of edges 88, 89 of disc 82, such as edge 89, contacts roundel 54 as the disc rotates in, for instance, a counterclockwise direction as viewed in FIG. 3, the force of edge 89 acting upon roundel 54 will cause the roundel 54, arm 52, and cam reverser 50 to be repositioned incrementally counter clockwise as a function of the spacing between adjacent saw tooth members 46,48 (see FIG. 2). The resulting repositioning of the cam reverser results in a change in direction of rotation of sleeve 60 along with attached nozzle housing 12. On the completion of incremental steps of rotation in the counter clockwise direction, edge 88 of disc 82 will contact the other side of roundel 54 and cause it to be translated incrementally clockwise. Such translation of the roundel 54 is translated via arm 52 to cam reverser 50 and the rotation of sleeve 60 and nozzle housing 12 will change direction.

Figure 4:
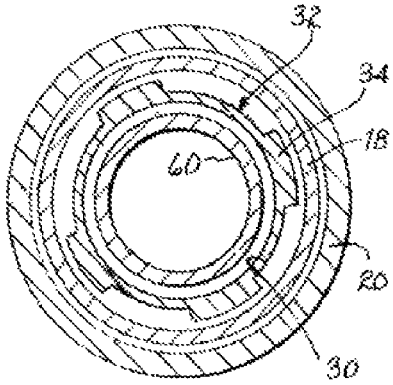
FIG. 4 is a cross sectional view taken along lines 4-4 shown in FIG. 2.

FIG. 4 primarily illustrates lugs 34 of retainer 32 in engagement with lugs 30 of cylinder 18, all of which are disposed within conduit 20.

Figure 2:
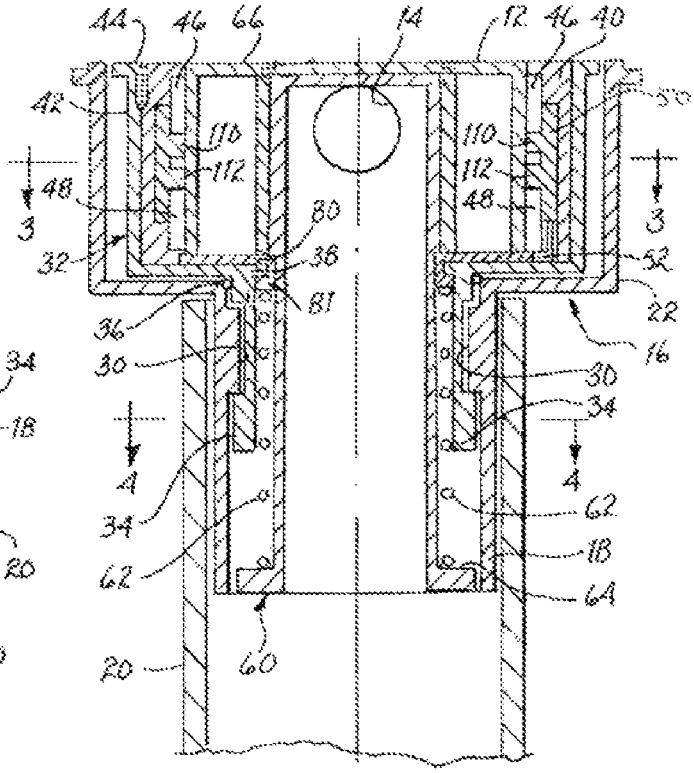
FIG. 2 is a cross sectional view of the nozzle assembly shown in the retracted position.
Figure 5:
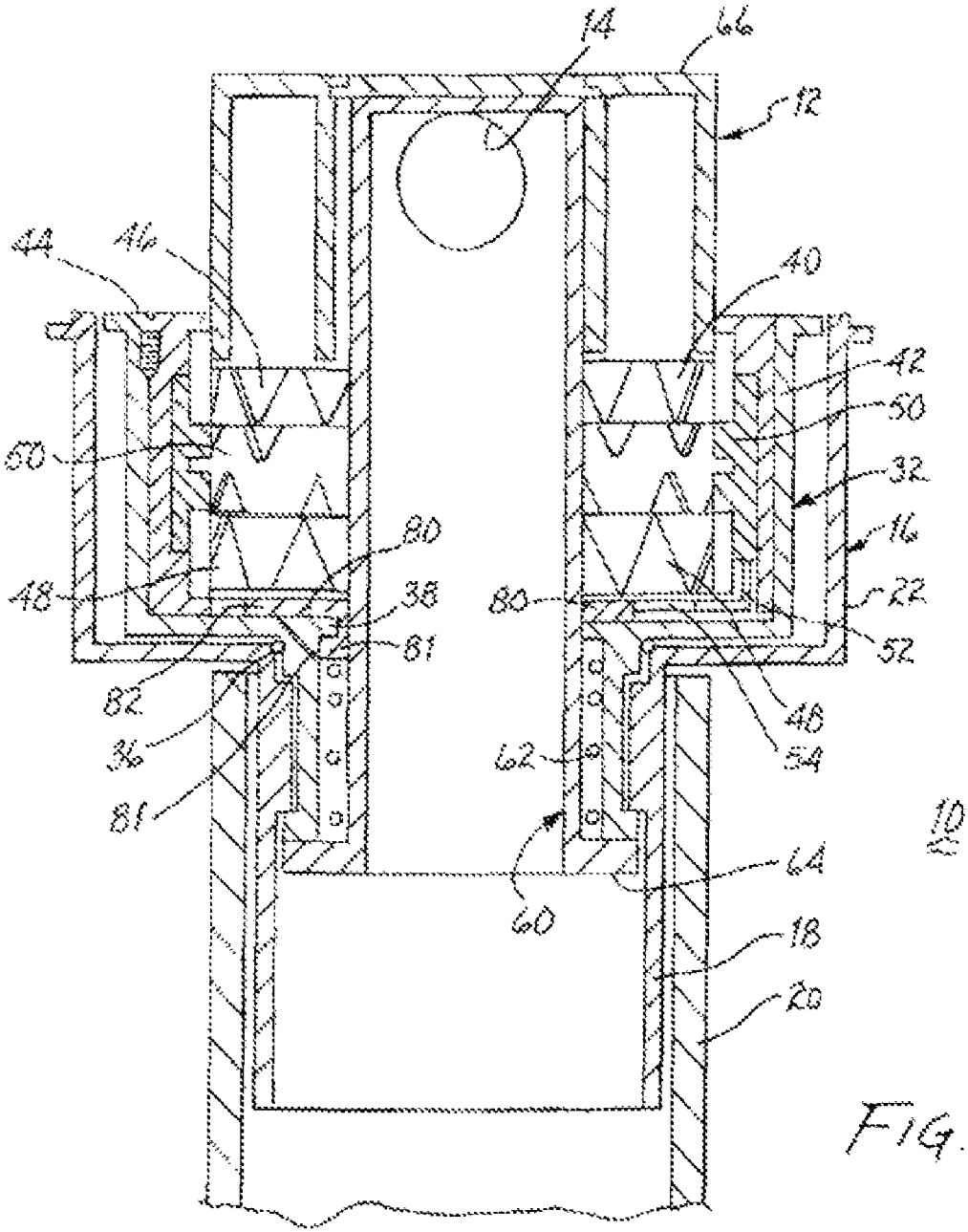
FIG. 5 is a cross sectional view of the nozzle assembly in the extended position.

FIG. 5 illustrates a particular implementation of a nozzle housing 12 in the extended position. In this condition, water pressure exists within conduit 20 and causes sleeve 60 to be raised against the bias supplied by coil spring 62. As the sleeve 60 rises, it causes nozzle housing 12 to rise, as illustrated. As the nozzle housing 12 rises, pins 70, 72 rise in the spaces formed by the edges of intermediate saw tooth members 46. Because the pins 70,72 bear against the edges of saw tooth members 46, which are slanted opposed sides, the pins 70,72 are angularly translated about the vertical axis of nozzle 10, rotating nozzle housing 12 incrementally a corresponding angular distance. When water pressure within conduit 20 is terminated, the bias supplied by coil spring 62 will cause sleeve 60 to retract and the nozzle housing 12 will be lowered within section 22, as shown in FIGS. 1 and 2. As nozzle housing 12 is lowered, pins 70, 72 contact the edges of saw tooth members 48 and angularly translate once again, rotating the nozzle housing 12 incrementally a corresponding angular distance. The direction of rotation (clockwise or counterclockwise) is controlled by cam reverser 50 and will be described in further detail with reference to FIGS. 7 and 8.

FIG. 6 illustrates an exploded view of the primary components of a particular implementation of a nozzle assembly 10 and FIG. 6A illustrates an implementation of a pattern cam 80 in more detail. As illustrated, sleeve 60 may include lugs 90, 92 cooperating with corresponding lugs in nozzle housing 12 to function similarly to a bayonet fitting and lock the sleeve 60 with the housing 12. Upon locking, the outlet 94 of the sleeve 60 may be oriented with either of diametrically opposed outlets 14, 14A in nozzle housing 12.

A disc 96 may be centrally located in the top of the nozzle housing 12 to close opening 98, that is formed primarily for manufacturing purposes. The disc 96 may include opposed lugs 100, 102 which slidably engage corresponding opposed slots, of which slot 104 is shown. A lip 106 is disposed at the top of each of the slots 104 to prevent ejection of disc 96. The four sets of channels 108 illustrated in the particular implementation of a nozzle housing 12 may have no functional purpose and may be employed primarily for manufacturing reasons to minimize the thickness of the plastic of the nozzle housing and avoid shrinkage after manufacture. In the implementation illustrated, pattern cam 80 includes a disc 82 representing approximately 180 degrees between edges 88, 89, which disc controls the angular excursion of nozzle housing 12. However, the angular excursion can be easily reduced to 90 degrees or set to any other value by simply substituting another pattern cam 80 having an annular extension such that the angular distance between edges 88, 89 corresponds with the angular rotation wanted of for the nozzle housing 12.

Figure 7:
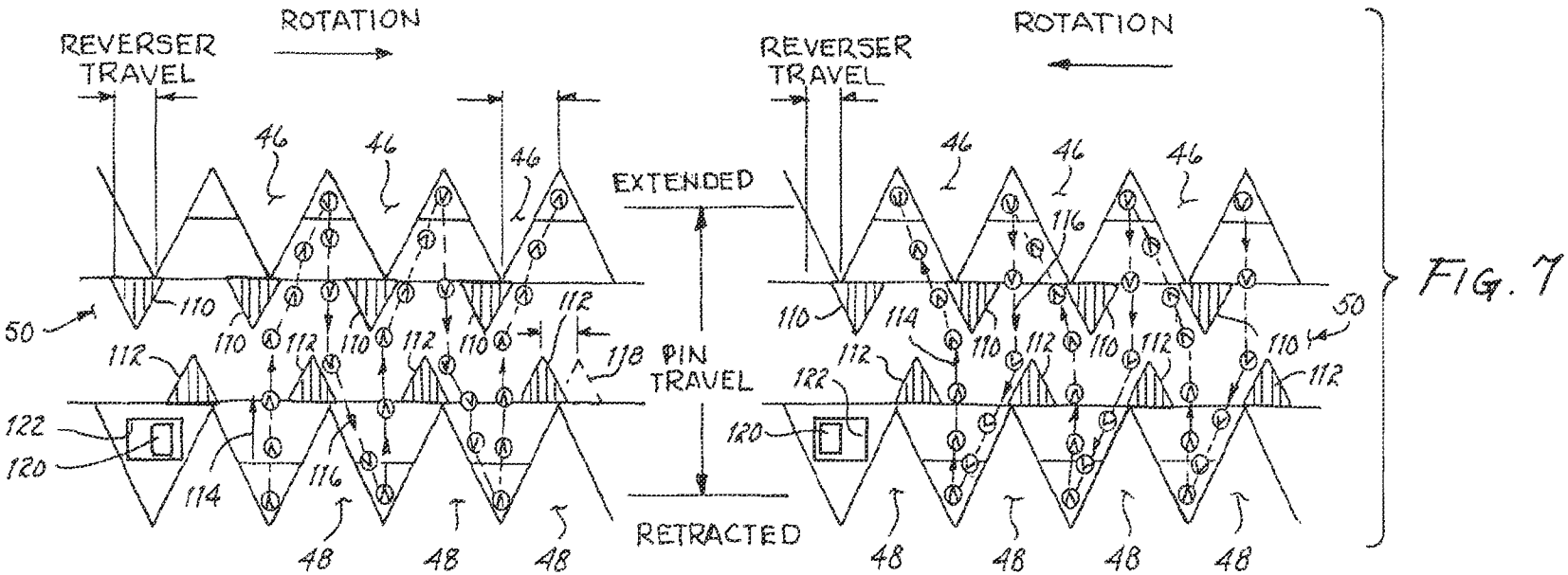
FIG. 7 illustrates the travel path of a pin through the cam while incrementally rotating the nozzle assembly.

Referring to FIG. 7, the incremental rotation, automatic reversal, and subsequent incremental rotation of a particular implementation of a nozzle housing 12 is illustrated. Saw tooth members 46, located on cam ring 40, are representatively illustrated along with saw tooth members 48 also mounted upon the cam ring 40. Cam reverser 50 includes a series of upper triangularly shaped protrusions 110, or other upper pin guides 110, pointed downwardly (see also FIG. 2) and a plurality of lower triangularly shaped protrusions 112, or other lower pin guides 112. One of pins 70, 72 is represented by a roundel having therein either a symbol of V or A. The symbol V represents downward movement of the pin and the symbol A represents upward movement of the pin. When sleeve 60 is forced upwardly by water pressure within conduit 20, nozzle housing 12 and pins 70, 72 extending therefrom will travel upwardly, as represented by arrow 114, from in-between the junction of two adjacent saw tooth members 48, as depicted on the left side of FIG. 7.

Upon upward movement, the pin(s) 70, 72 will strike protrusion 110 and be deflected to the right, or in the clockwise direction, as indicated. Such deflection will incrementally rotate nozzle housing 12 clockwise. After the pin(s) 70, 72 passes protrusion 110, it will be guided to the right by the edge of saw tooth member 46 until it reaches the junction between adjacent saw tooth members 46. In particular implementations, the degree of rotation of nozzle housing 12 may be commensurate with the angular distance between the junction between adjacent saw tooth members 48 and the junction between adjacent saw tooth members 46. After water pressure within conduit 20 ceases, coil spring 62 causes retraction of sleeve 60 and nozzle housing 12. During such retraction, the pin(s) 70,72 moves vertically downwardly, as represented by arrow 116, until it strikes an edge of protrusion 112. This protrusion 112 will guide the pin 70,72 adjacent an edge of saw tooth members 48 until it comes to rest at the junction between the two adjacent saw tooth members 48.

In particular implementations, saw tooth members 46 may be offset from saw tooth members 48 by one-half of the width of the saw tooth members 46, 48, when saw tooth members 46, 48 have substantially identical dimensions. In other particular implementations, the degree of rotation of the nozzle housing 12 during each incremental rotation step may be governed by the dissimilarly between the relative dimensions of the saw tooth members 46, 48, e.g., the nozzle housing 12 may rotate more on its way down rather than on its way up.

As nozzle housing 12 rotates, sleeve 60 will rotate commensurately. Such rotation of the sleeve will cause pattern cam 80 (see FIG. 3) to rotate until one of edges 88, 89 contacts roundel 54 and causes the roundel 54 to move angularly. Such angular movement of roundel 54 is translated to commensurate rotational (angular) movement of cam reverser 50. The angular displacement of the cam reverser 50 is depicted and represented by protrusion 118 shown in dashed lines to indicate movement of each of protrusions 112 (and protrusions 110). The resulting relationship between protrusions 110, 112 and saw tooth members 46, 48 is depicted in the right half of FIG. 7.

As illustrated, the pin(s) 70, 72 will move upwardly from in between saw tooth members 48 commensurate with upward movement of nozzle housing 12 upon the presence of water pressure within conduit 20. As the pin 70, 72 moves upwardly, it will contact protrusion 110 and be directed to the left, or counterclockwise, (not to the right as formerly described). Thereafter, the pin(s) 70, 72 will slide along the edge of saw tooth members 46 until reaching the junction between adjacent saw tooth members 46. Upon cessation of water pressure within conduit 20, sleeve 60 and nozzle housing 12 will retract and the pin(s) 70, 72 will move until it strikes the edge of protrusion 112. This edge will guide the pin(s) 70, 72 onto the edge of a saw tooth member 48 until it bottoms out at the junction between adjacent saw tooth members 48; this position corresponds with the retracted position of sleeve 60 and nozzle housing 12. The resulting incremental rotation of nozzle housing 12 will continue until the other edge of cam pattern 80 contacts and causes rotational movement of roundel 54 to relocate the cam reverser 50.

To limit the rotational movement of cam reverser 50, a tab 120 extends from retainer 32 into penetrable engagement with a slot 122 formed in cam reverser 50. The movement of the slot 122 with respect to the tab 120 controls the degree of angular excursion of the cam reverser 50 each time the rotational movement is changed; furthermore, the movement of the slot 122 from one side to the other precisely controls the repositioning of protrusions 110, 112 to ensure alignment with the respective saw tooth members 46, 48 and thereby accurately directs the engaging pin 70,72 to the corresponding edge of the respective saw tooth member 46, 48.

Figure 8:
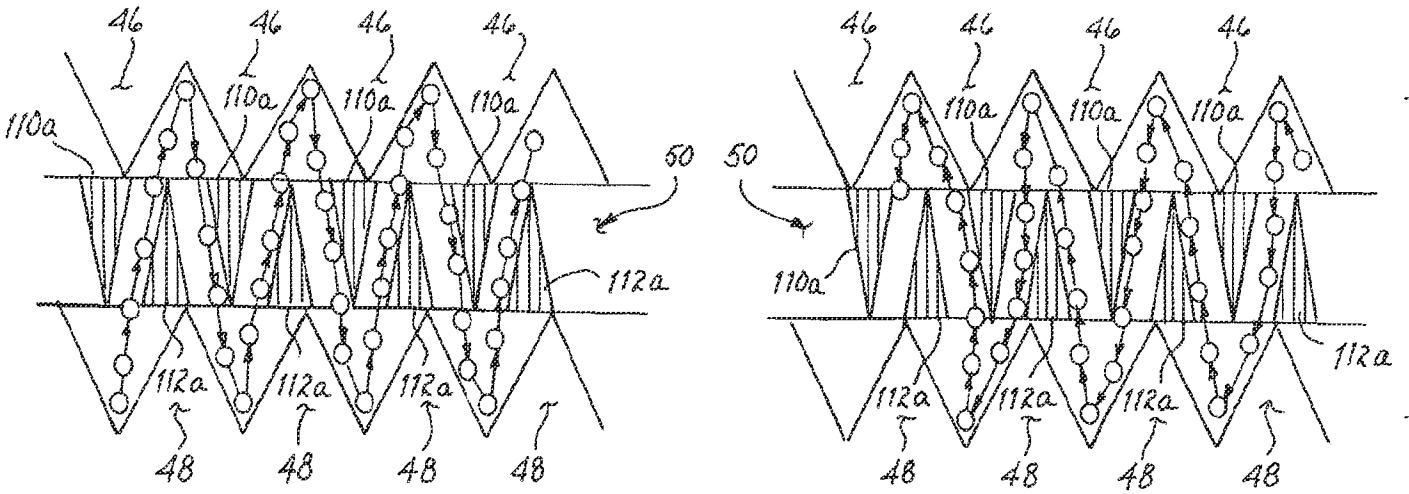
FIG. 8 illustrates the travel path of the pin through an alternative cam while incrementally rotating the nozzle assembly.

Referring to FIG. 8, another particular implementation of saw tooth members and protrusions 110A and 112A is illustrated. Protrusions 110A and 112A are generally adjacent one another whereby the tip of one protrusion 110A, 112A is essentially horizontally aligned with the base of an adjacent protrusion 110A, 112A. Such arrangement may provide a greater degree of guidance for the pin(s) 70, 72 as they move up and down adjacent the protrusions 110A, 112A and into the junctions between upper and lower adjacent saw tooth members. Other than these structural distinctions, implementations like those illustrated in FIG. 8 function and operate similarly to those illustrated and described with reference to FIG. 7.

It may be noted that the degree of total angular rotation of nozzle housing 12 is, as stated above, a function of the angular extent of disc 82 between edges 88, 89 of pattern cam 80. To change the degree of total angular rotation excursion of nozzle housing 12, an existing pattern cam 80 may be readily substituted with another pattern cam having an angularly differently configured disc 82 to increase or decrease the amount of total angular rotation of the nozzle housing 12.

In the past, the orientation of a stream of water emanating from a nozzle was set by carefully aligning the nozzle assembly as a whole in the desired direction. Such alignment was generally semi-permanent and adjustment was usually quite difficult. Because of such difficulty, workmen tended to have the attitude that "close enough was good enough". Unfortunately, the cleaning capability was usually compromised. With implementations of nozzle assemblies 10, adjustment can be more readily and easily made by loosening screw 44 (see FIGS. 1 and 2) and rotating cam ring 40 until the water stream is ejected precisely to the area of interest. To set the cam ring 40 in this new position, screw 44 is tightened.

Structure.

Figure 9:
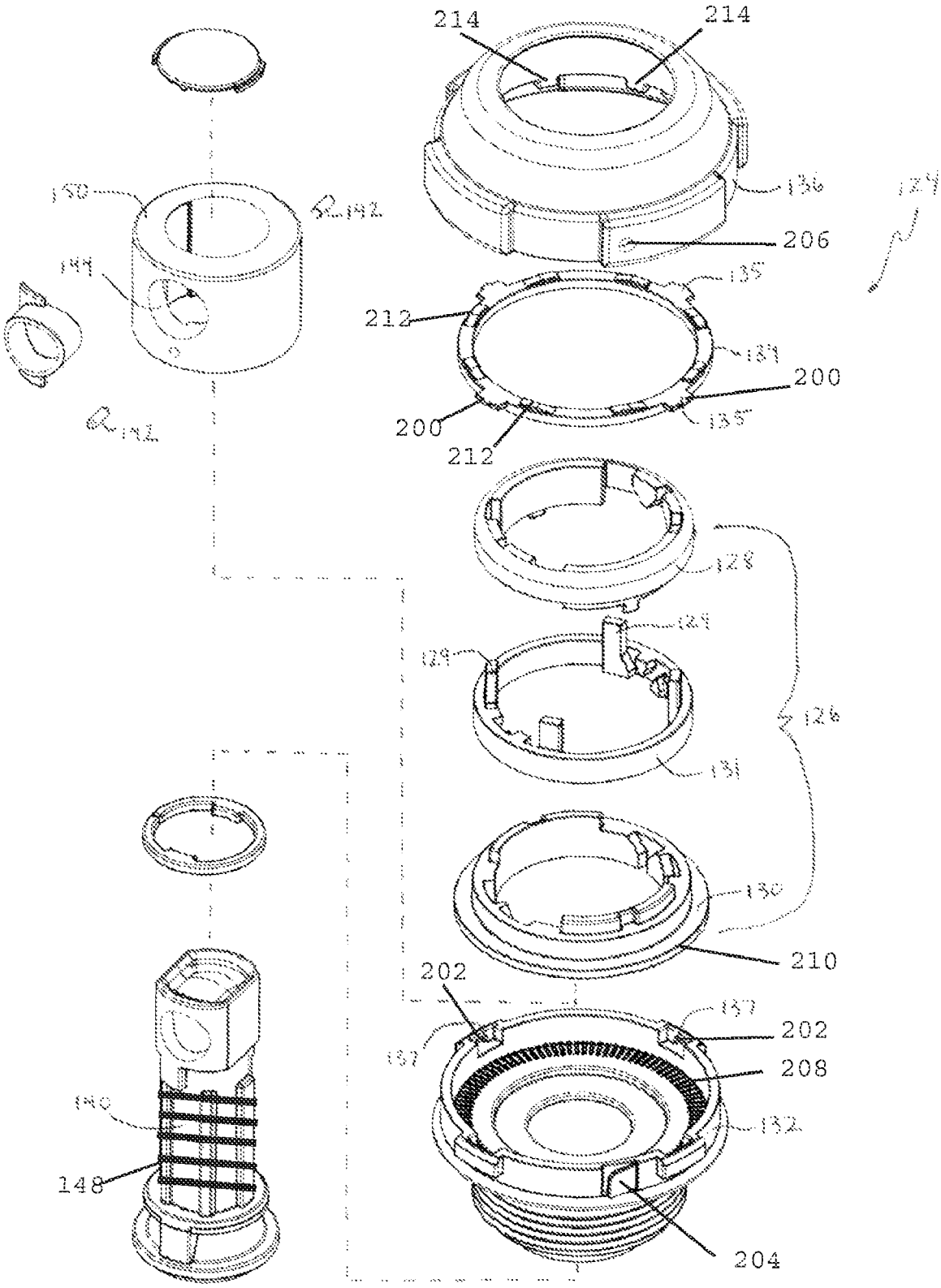
FIG. 9 is an exploded view of an implementation of a nozzle assembly.

Referring to FIG. 9, an exploded view of another implementation of a cleaning head assembly (alternatively called a nozzle assembly) 124 is illustrated. The cleaning head assembly 124 may include a cam assembly (alternatively called a cam ring) 126. As illustrated, in particular implementations the cam assembly 126 may include an upper section 128, a slidable section 131 (alternatively called a cam reverser), and a lower section 130. The slidable section 131 may include at least one shifter 129 that extends from the slidable section into the upper section 128. The cam assembly 126 may couple into a housing (alternatively called a body) 132. When coupled into the housing 132, a locking ring 134 may be coupled over the lower section 130 and includes lugs 135 that engage within locking features 137 in the housing 132. In particular implementations, the upper section 128 and lower section 130 of the cam assembly 126 may be fixedly coupled together through, by non-limiting example, a sonic weld, heat staking, adhesive or other method of fixedly coupling two plastic parts together. While the upper section 128 and lower section 130 are fixedly coupled together, the slidable section 131 remains slidably engaged between them and is free to move rotatably with respect to the upper and lower sections 128, 130, respectively.

The tips of the lugs 135, of the particular implementation shown in FIG. 9, are configured with prongs 200 that fit into the recesses 202 of the locking features 137 in the housing 132. Placement of the locking ring 134 over the cam assembly 126 in the lower section 130 holds the cam assembly 126 in place through mating of the prongs 200 with the recesses 202. In many cases, the strength of the engagement of the prongs 200 into the recesses 202 is strong enough that the up and down nozzle action in the cam assembly 126 so that the nozzle 140 may be tested without the cap ring 136 added. This allows an installer to rotationally adjust the cam assembly 126 in relation to the lower section 130 prior to locking all of the components in place with the cap ring 136. By rotationally adjusting the cam assembly 126 in relation to the lower section 130, the directional orientation of the nozzle 140 may be set regardless of the original orientation of the in-wall fitting for the nozzle assembly. In other words, even though the in-wall fitting for the nozzle assembly yields an unknown radial direction for the final nozzle housing, an installer can adjust the direction of the nozzle during installation to any orientation needed.

A cap ring 136 may be coupled over the cam assembly 126 against the locking ring 134. Use of the cap ring 136 may allow, in particular implementations, for the lower and upper sections 130, 128 of the cam assembly 126 to be rendered substantially immobile in relation to the housing 132 during operation of the cleaning head assembly 124 while leaving the slidable section 131 capable of rotational sliding motion. The cap ring 136 may be loosened or removed by pressing a locking arm 204 coupled to the housing 132 which is engaged with the cap ring 136 inwardly through an opening 206 in the cap ring 136 until the locking arm 204 disengages from the cap ring 136. The locking arm 204 is biased to a position that engages the cap ring 136. For example, the locking arm 204 may be formed of a flexible material that self-biases the locking arm 204. As another example, the locking arm 204 may be formed as a lever with a spring, or through other structures known in the art for manufacturing a biased arm.

As illustrated in FIG. 9, the ability of the cap ring 136 to render the lower and upper sections 128, 130 of the cam assembly 126 substantially immobile is aided, in particular implementations, by a plurality of ridges 208 distributed along the surface of the housing 132 that couple with the lower section 130 of the cam assembly 126. As illustrated, the lower section 130 includes a plurality of grooves 210 that couple with the plurality of ridges 208 of the housing 132 under compressive force created by the rotation of the cap ring 136. In particular implementations, the compressive force generated by the rotation of the cap ring 136 may be increased through a plurality of ramp members 212 extending from the locking ring 134 that engage with projections 214 of the cap ring 136 while it is rotated. As the cap ring 136 is rotated, the force on the locking ring 134 increases as the projections 214 engage with the ramp members 212, pressing the locking ring 134 against the lower section 130 of the cam assembly 126. As the force against the lower section 130 increases, the plurality of grooves 210 begin to increasingly engage with the plurality of ridges 208, thereby increasingly restricting the rotational motion of the lower section 130 until it is rendered substantially immobile. In particular implementations, once the cap ring 136 has been rotated sufficiently to render the lower section 130 immobile, the locking arm 204 may engage with the cap ring 136 to prevent any unintentional loosening of the cleaning head assembly 124 thereby maintaining the positional relationship between the cam assembly 126 and the housing 132.

Figure 10:
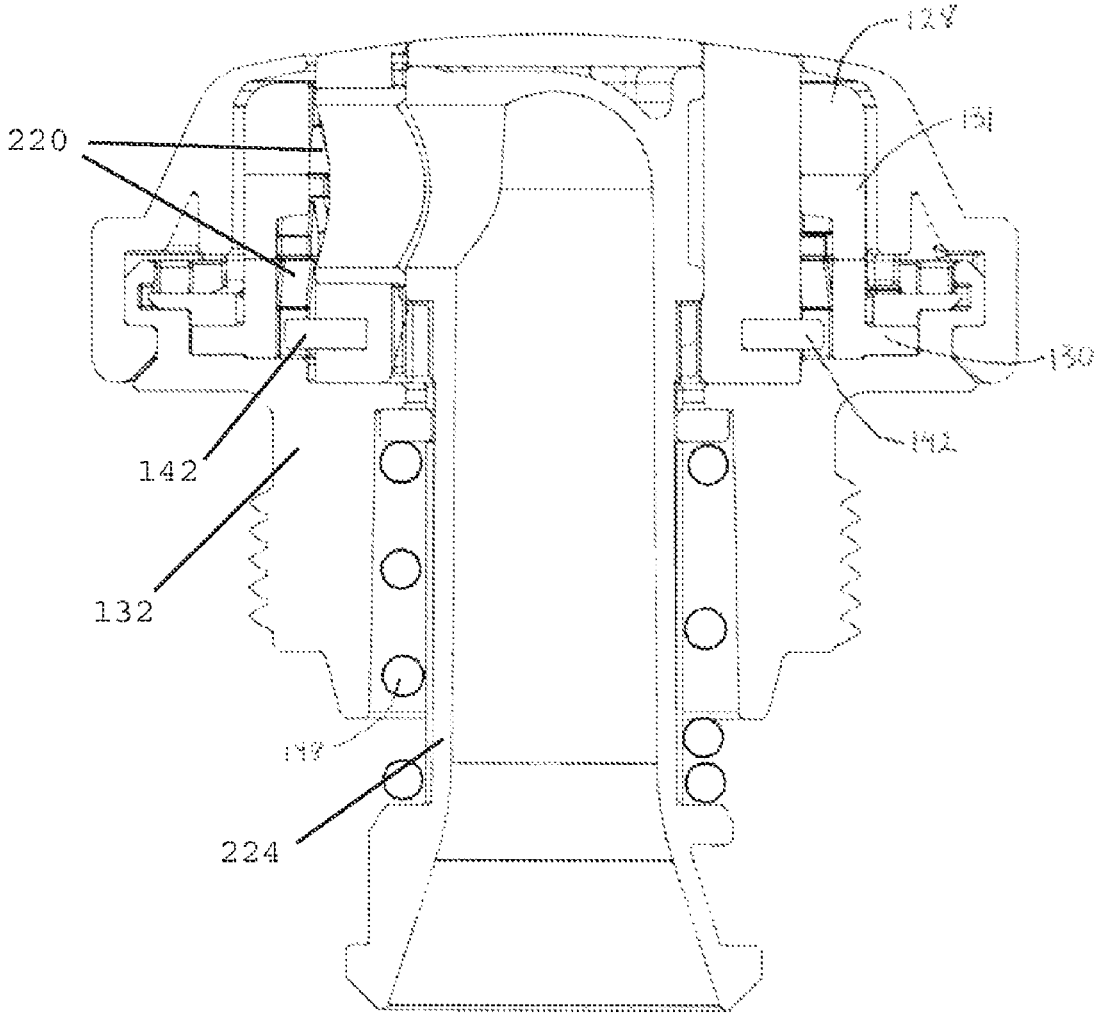
FIG. 10 is a cross-sectional view of an assembled nozzle assembly along sectional line A in FIG. 9.
Figure 15:
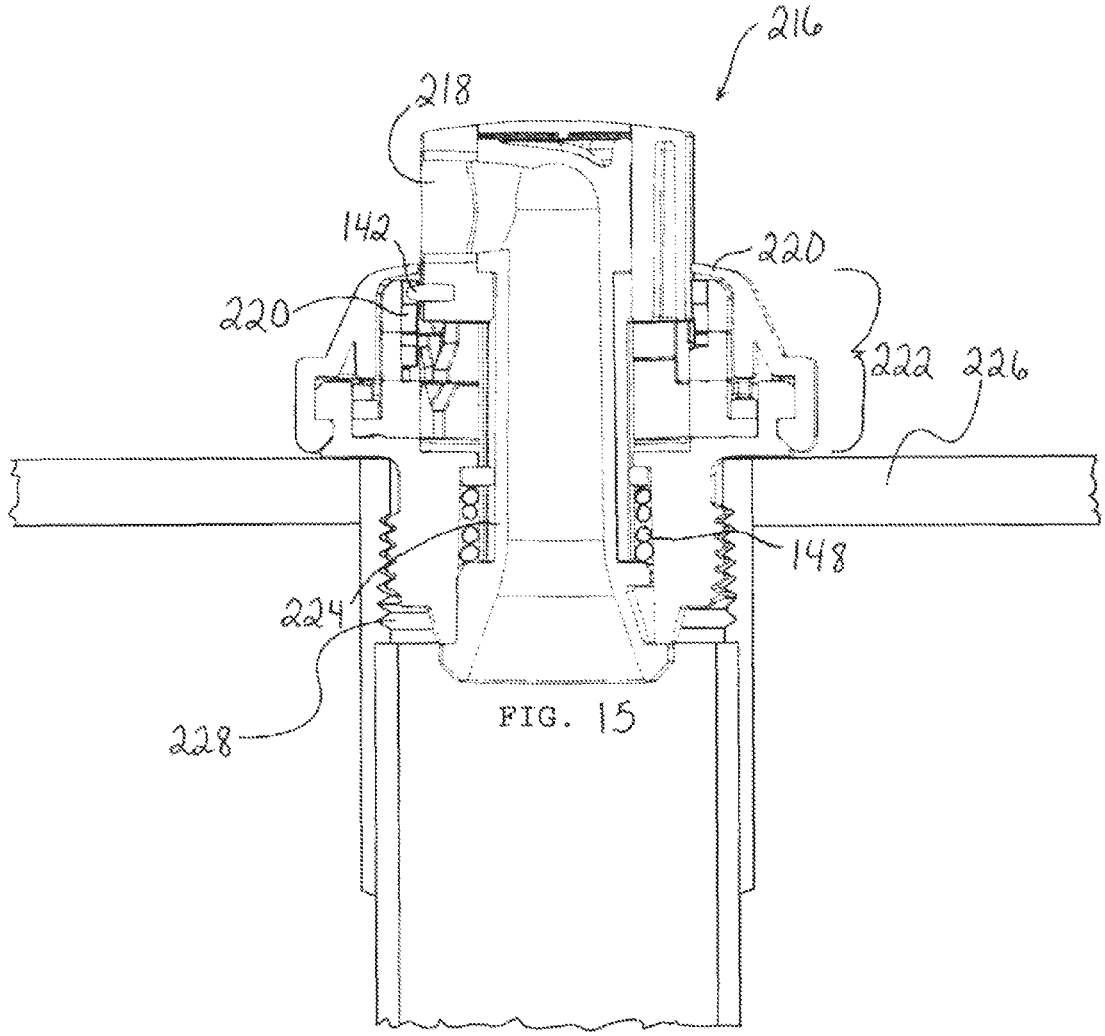
FIG. 15 is a cross-sectional view of an assembled nozzle assembly similar to that of FIG. 10, but in an extended position.

As illustrated in FIG. 9, implementations of a cleaning head assembly 124 may include a stem (sleeve) 140 that extends through the housing 132 and the cam assembly 126. In the particular implementation illustrated in FIG. 9, the stem 140 comprises at least one pin 142 that extends from a side of a head 150 (nozzle housing) that couples over the top of the stem 140. In other implementations, the at least one pin 142 may couple to other components associated with the stem 140 so that in either case (whether extending from the side of the head 150 or from some other component associated with the stem 140 or from the stem directly), the at least one pin 142 can be said to extend from the stem 140. In particular implementations of a stem 140, two or more pins 142 may be included, and the relation between the direction the pin 142 extends from the side of the stem 140 relative to the outlet 144 may range from about parallel to about perpendicular, depending upon system requirements. The pin 142 for these implementations engages with the cam assembly 124 within the upper section 128, the slidable section 131, and the lower section 130, as illustrated in FIG. 10. In particular implementations, the pin 142 may contact the edges of a plurality of saw teeth 146 within the cam assembly 126. The stem 140 may further include a spring element (coil spring) 148 (shown on FIG. 10) configured to provide bias force against the stem 140 when it is extended from the housing 132. FIG. 15 illustrates the cleaning head assembly 216 in an extended position, where the outlet 218 is raised above an upper surface of the cap ring 220 and the pin 142 is engaged against a surface of the saw teeth 220 in the upper section 6 of the cam assembly 222. In the extended position, the stem 224 is raised by water pressure force against the bias of the spring element 148. FIG. 15 also illustrates a swimming pool wall 226 with a threaded fitting 228 mounted in the wall. The cleaning head assembly 216 threadedly mates with the threaded fitting 228 in this implementation. Other coupling types are known four coupling a cleaning head assembly to a wall fitting and may equivalently be used in place of the threaded fitting shown here.

Use

Referring to FIG. 15, an illustration of the interior of a cam assembly (example as cam assembly 126 in FIG. 9) for a cleaning head assembly (example as cleaning head assembly 124 in FIG. 9) is shown with reference to the particular implementation of FIG. 9 as an example. As illustrated, the edges of the saw teeth 152, 154, 156, or other guides 152, 154, 156, of the upper section 128 and slidable section 131 of the cam assembly 126 form a plurality of channels 158, 160, 162 in which a pin 142 travels during operation of a cleaning head assembly 124. For ease of understanding, slidable section 131 has been marked in FIGS. 11 and 12 with right downwardly sloping hatch marks. The pin 142 has been marked with right upwardly sloping hatch marks. Although the FIGs. Show more than one pin 142, this is intended to be illustrative of the movement of the pin 142 from one end of a channel to another end and not necessarily that there are two pins 142 in the particular implementation.

During operation of the cleaning head assembly, water pressure force is intermittently exerted on the stem 140, forcing it to extend upwardly. As the stem 140 moves upwardly, the pin 142 also travels upwardly in a first channel 158 formed to a side of the edges of the saw teeth 152, 154. It should be understood that in its ordinary rest position, the pin 142 would not be in the upper position (as 142*a*) between tooth 152 of the upper cam 128 and the shifter 129, but would be resting within the lower cam section 130. When the water pressure force is removed, the bias of the spring element 148 withdraws the stem 140 into the housing 132 (see FIG. 9). As the stem 140 withdraws, the pin 142 travels downwardly through the first channel 158 (as indicated by the arrow 164). In the process, the rotational position of the stem 140 may travel incrementally clockwise (or counterclockwise depending upon the direction of movement for the stem). When the intermittent water pressure force is once again exerted on the stem 140, the pin 142 travels upwardly between the saw teeth 154, 156 into the second channel 160, as indicated by the arrow 168. Once again, the rotational position of the stem 140 may continue to move incrementally clockwise (or counterclockwise) until it rests in the position illustrated in FIG. 12 as pin 142*d*. It should be noted that when the pin 142*d* initially comes to rest in the position illustrated in FIG. 12, the slidable section 131 (and integral shifter 129) is still in its position to the left illustrated in FIG. 12.

Figure 12:
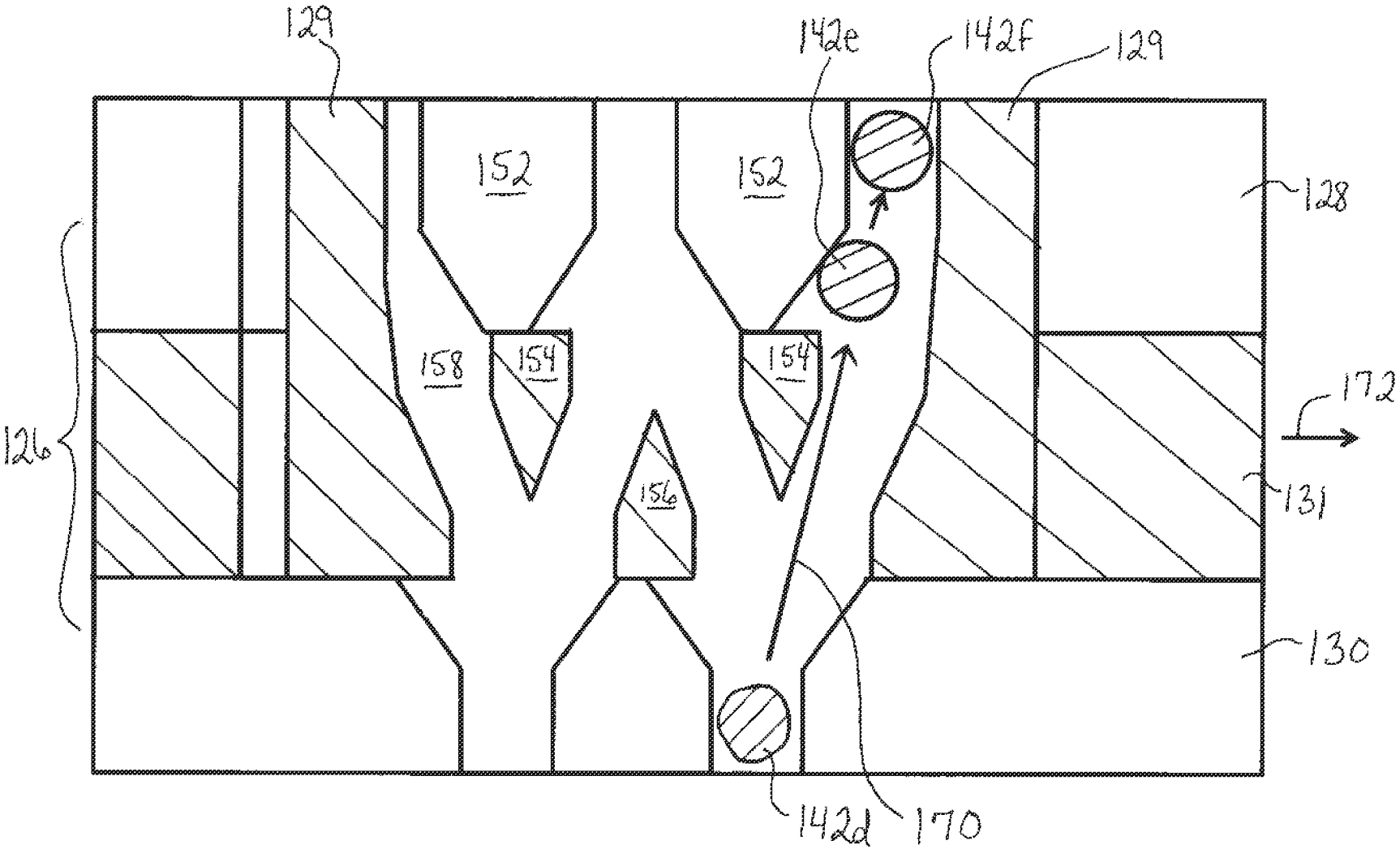
FIG. 12 illustrates the travel path of a pin through the cam of an implementation of a nozzle assembly indicating the movement of the slidable section of the cam followed by intermittent rotation counterclockwise.
Figure 13:
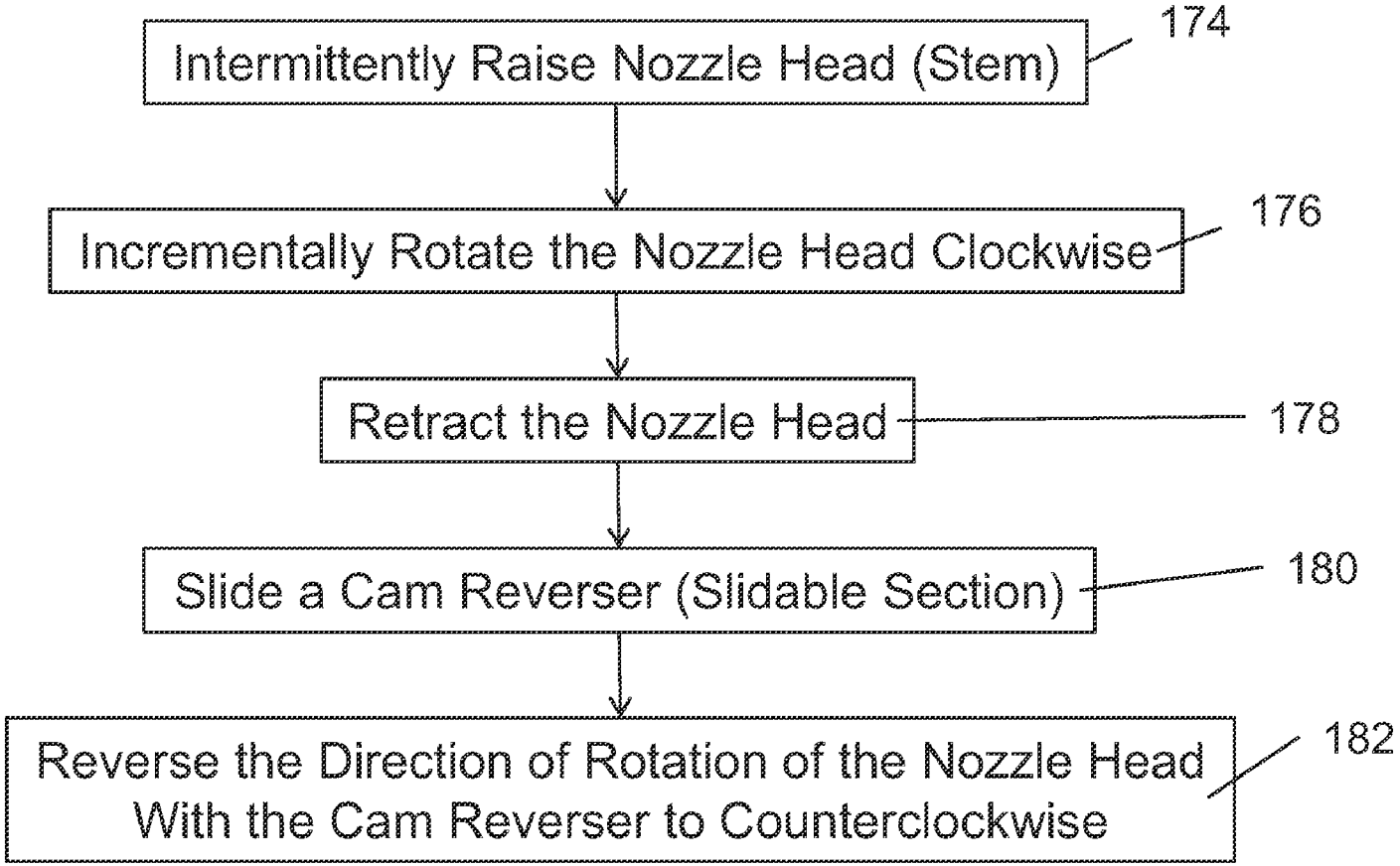
FIG. 13 is a flow diagram of the steps of a method of cleaning a swimming pool utilized by particular implementations of swimming pool cleaning heads.

Referring to FIG. 12, as the water pressure force is again removed from the stem 140, the bias of the spring element 148 draws the stem 140 (see FIG. 9) downward again, causing the pin 142 to travel between saw teeth 156, 154, further moving the rotational position of the stem 140 incrementally clockwise (or counterclockwise). By repeating the intermittent application and removal of water pressure force, stem 140 rotate until the pin 142 enters the third channel 162, as indicated by arrow 170 (FIG. 12 in a first slidable section position and FIG. 13 illustrating a second slidable section position) for as many channels the cam assembly includes until it reaches the limits of the cam rotation. For the implementation shown in FIGS. 12 and 13, the implementation includes only four channels 158, 230, 160 and 162.

After the pin 142*d* is positioned at the start of the final channel 162, with the shifter 129 in its position illustrated in FIG. 12, water pressure force is exerted on the stem 140 and the pin 142 enters the final channel 162 as indicated by the arrows. When the pin 142 reaches its position as pin 142*e* in FIG. 12, the interference of the pin 142*e* with the shifter 129 to its right pushes the shifter 129 (and integral slidable section 131) to the right so that the pin 142 can move to its end position as pin 142*f*.

Figure 11:
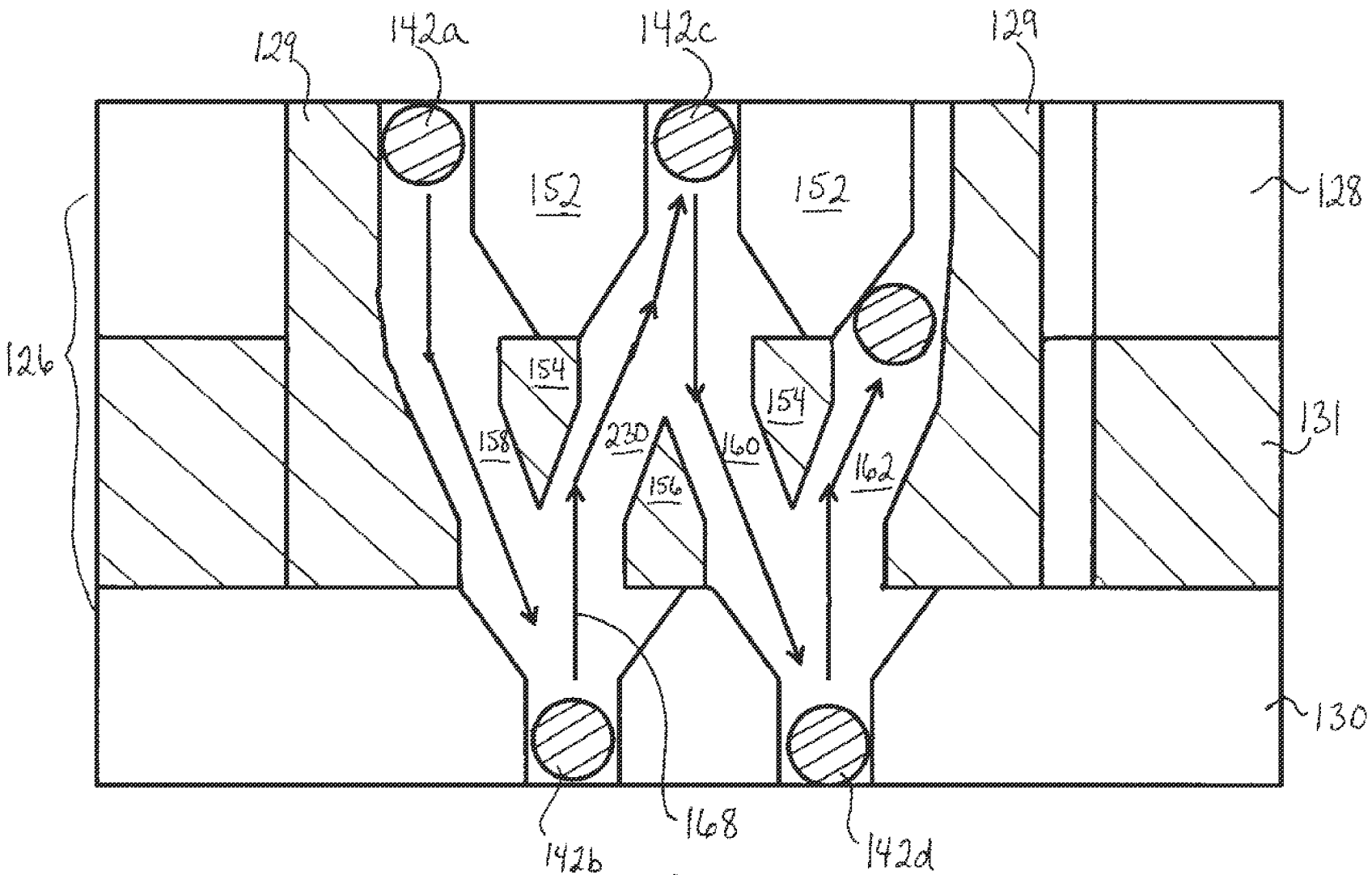
FIG. 11 illustrates the travel path of a pin through the cam of an implementation of a nozzle assembly during intermittent rotation clockwise.

The top of channel 162 is originally narrower than the diameter of the pin 142 (see FIG. 11 for its earlier position). As the pin 142 enters channel 162 under water pressure force as indicated by arrow 170, the pin 142 presses against the edge of saw tooth 152 and against shifter 129, moving the shifter 129 and inducing slidable rotation of the slidable section 131 in relation to the upper and lower cam sections 128 and 130, and a widening of channel 162 to allow the pin 142 to fully enter channel 162. Arrow 172 in FIG. 12 shows the direction of rotation of the slidable section 131 in relation to the remainder of the cam assembly 126. As channel 162 widens through rotational movement of the shifter 129 coupled to the slidable section 131 of the cam assembly, the width of channel 158 is reduced (see FIG. 12 as compared with FIG. 11). When the pin 142 reaches channel 162 and completes widening it, the cleaning head assembly 124 (FIG. 9) has reached a first limit position or a predetermined limit after completing a predetermined number of rotational steps and is no longer able to rotate further in the clockwise direction.

When the water pressure force is removed from the stem 140, the pin 142 travels back down channel 162. As the pin 142 does so, the angular position of the stem 140 begins to be incrementally and/or automatically adjusted in the counterclockwise direction just like it was previously in the clockwise direction. Under the influence of the intermittent water pressure force, and through the action of the engagement of the pin 142 within the cam assembly 126, the angular position of the stem 140 continues to incrementally travel in the counterclockwise direction until the pin 142 slidably rotates the slidable section 131 back by entering and widening channel 158, or through reaching a second limit position or predetermined limit. Through automatic positioning and reversal of the pin movement within the predetermined limits of the cam assembly, the cleaning head assembly automatically begins another cycle of movement in the clockwise direction after completion of a predetermined number of rotational steps. The ability of the slidable section 131 to slidably rotate with respect to the lower and upper sections 130, 128 enables the automatic reversal of the direction of rotation of particular implementations of cleaning head assemblies 124.

While the implementation of a cam assembly 126 illustrated in FIGS. 11 and 12 comprise only a few saw teeth 152, 154, 156, and three channels 158, 160 and 162, in other particular implementations, any number of saw teeth and corresponding channels may be employed. Such implementations may, therefore, incorporate smaller or larger rotational increments (steps), be evenly spaced or unevenly spaced, and/or incorporate a wider or shorter range of rotational movement before automatically reversing direction. For example, the saw teeth 152, 154, 156 may be spaced any distance apart to increase or decrease the stepwise rotational distance the stem 140 turns as water pressure force is intermittently applied. In addition, the degree of rotation of the stem 140 allowed by the number of saw teeth 152, 154, 156 employed may range in particular implementations from substantially 360 degrees to substantially 0 degrees, depending upon the desired location and function of the cleaning head assembly 124. The rotation range to which particular implementations may be designed is limited only by the space needed for the left and right edges of the shifter 129 and the stops provided on the left and right of the upper and/or lower cam sections 128, 130. It will be understood, however, that the actual dimensions of the stops and edges may vary greatly by the particular materials used to create the cam assembly 216 and the pressures to which the cam assembly is exposed. It is anticipated, however, that in most cases the rotation range needed will be sufficiently below 360 degrees and sufficiently above 0 degrees that the stops and shifter edges widths will not be a concern.

Also, in particular implementations, the relative sizes of the saw teeth 152, 154, 156 and/or angles of the channels 158, 160, 162 may be varied to allow the stem 140 to rotate a greater angular distance during certain rotational cycles than in others. Implementations employing regularly sized and spaced saw teeth 152, 154, 156 may employ a method of cleaning a pool floor that includes rotating the position of the stem 140 a certain predetermined distance within a predetermined or irregular interval of time. In implementations employing irregularly sized and/or spaced saw teeth 152, 154, 156, the method may employ rotating the position of the stem 140 according to a predefined pattern during a predetermined or irregular interval of time.

Referring to FIG. 13, a flowchart of method steps is illustrated. Implementations of a pool cleaning head may include a method of use that may include the steps of intermittently raising the nozzle head (stem, step 174), incrementally rotating the nozzle head clockwise (step 176), and retracting the nozzle head (step 178). In particular implementations, steps 174, 176, and 178 may be repeated multiple times, or may occur only once. Also, during the step of retracting the nozzle head (step 178), the nozzle head may also be incrementally rotated clockwise (step 176). As illustrated, method may also include the step of sliding a cam reverser (slidable section, step 180) and reversing the direction of rotation of the nozzle head with the cam reverser to counterclockwise (step 182). In particular implementations, these two steps may occur after a predetermined number of repetitions (cycles, or steps) of steps 174, 176 and 178, or may occur after just one occurrence of each of steps 174, 176, and 178. In implementations of a pool cleaning head, the sliding of the cam reverser (step 180) and the reversing of the direction of rotation of the nozzle head (step 182) may be repeated automatically (along with the repetitions of steps 174, 176, and 178) a predetermined number of times or according to a predefined pattern, allowing the pool cleaning head to incrementally and intermittently rotate through a particular arc of rotation or a fully 360 degrees for a desired period of time.

Implementations of cleaning head assemblies 216 employing removable and replaceable cam assemblies 222 may also enable adjustment of the overall orientation of the direction of total rotation (whether the rotation of the stem 140 is directed toward or away from a wall, for example) through exchanging of cam assemblies 222. In a conventional cleaning head assembly, the pattern of intermittent spray is fixed and the cam teeth of the cleaning head are built into the cleaning head assembly. Replacement of the cam teeth for a different cam configuration or to replace a broken cam tooth requires replacement of the entire cleaning head assembly. An exchange or a replacement of a cam assembly 222 in particular implementations disclosed herein may be facilitated by decoupling the cap ring 136, removing the locking ring 134, removal of the cam assembly 126 and then replacement of the cam assembly 126 with another cam assembly that is either the same as the first (if repairing), or has different characteristics than the first (such as a degree of total rotation different from the first cam assembly). The locking ring 134 may be reapplied, the cleaning head oriented and its extents tested, and the cap ring 136 reapplied.

This ability to change the overall orientation of the direction of total rotation of the cleaning head assembly 124 also allows for directional adjustment after the cleaning head assembly 124 is installed in a pool floor, step, or sidewall to ensure more optimal routing of contaminants regardless of the initial installation of the cleaning head assembly 124. The foregoing may allow an installer to tune the cleaning area covered by particular implementations of a cleaning head assembly 124 and perform adjustments without requiring specialized tools or lengthy disassembly or replacement.

Figure 14:
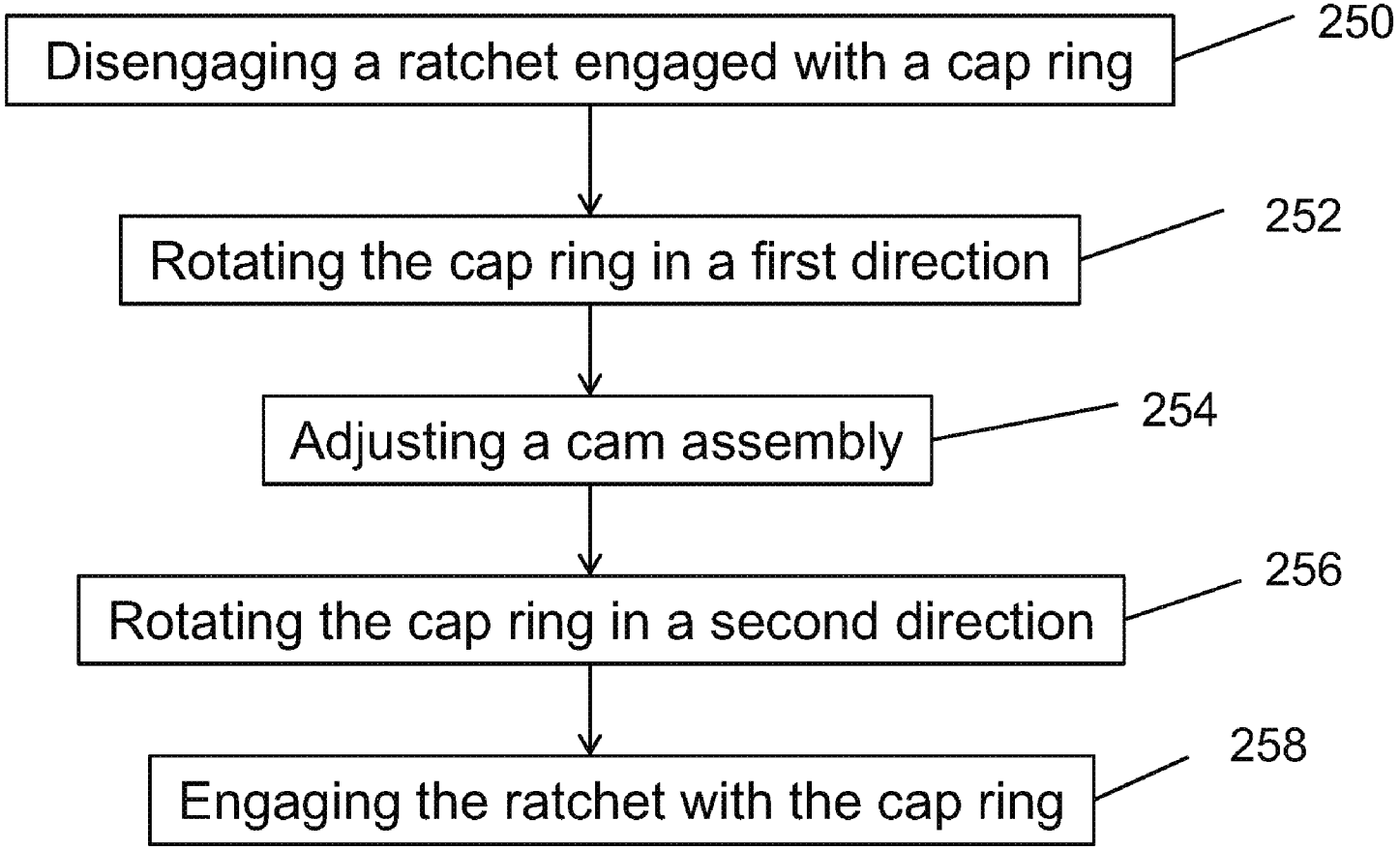
FIG. 14 is a flow diagram of an implementation of a method of adjusting a swimming pool cleaning head.

In addition, implementations of cleaning head assemblies 124 may utilize a method of adjusting the orientation of the cleaning head assembly 124 after the cleaning head assembly 124 has been installed. Referring to FIG. 14, an implementation of the method is illustrated. The method includes the steps of disengaging a locking arm 204 engaged with a cap ring 136 (step 250), rotating the cap ring 136 in a first direction (step 252), adjusting a cam assembly 126 (step 254), rotating the cap ring 136 in a second direction (step 256), and engaging the locking arm 204 with the cap ring 126 (step 258). The method may further include pressing on the locking arm 204 through an opening 206 in the cap ring 136. Rotating the cap ring 136 in a first direction (step 252) may further include disengaging a plurality of ridges 208 on a housing 132 with a plurality of grooves 210 on a lower section 130 of a cam assembly 126 and rotating the cap ring 136 in a second direction (step 256) may further include engaging the plurality of ridges 208 on the housing 132 with a plurality of grooves 210 on a lower section 130 of a cam assembly 126. Rotating the cap ring 136 in a first direction (step 252) may also include disengaging projections 214 of the cap ring 136 from ramp members 212 of a locking ring 134. Rotating the cap ring 136 in a second direction (step 256) may also include engaging projections 214 of the cap ring 136 with ramp members 212 of the locking ring 134. The first direction may be either clockwise or counterclockwise and the second direction will always be in a direction opposite the first direction. Adjusting the cam assembly 126 may include rotatably adjusting the position of the cam assembly 126 so that the path of travel of the stem 140 during automatic cleaning operation covers a desired area of the pool.

It will be understood that implementations are not limited to the specific components disclosed herein, as virtually any components consistent with the intended operation of a method and/or system implementation for a nozzle assembly may be utilized. Accordingly, for example, although particular nozzle assemblies may be disclosed, such components may comprise any shape, size, style, type, model, version, class, grade, measurement, concentration, material, weight, quantity, and/or the like consistent with the intended operation of a method and/or system implementation for a nozzle assembly may be used.

In places where the description above refers to particular implementations of nozzle assemblies, it should be readily apparent that a number of modifications may be made without departing from the spirit thereof and that these implementations may be applied to other nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A swimming pool cleaning head assembly comprising:

a cam housing;

a cam assembly removably coupled to the cam housing, the cam assembly comprising an upper section, a lower section and a rotatable section slidably disposed between the upper section and the lower section and rotatable between a first extent and a second extent, the cam assembly comprising a plurality of saw tooth members; and a stem extending through the cam assembly, the stem comprising a pin slidably engaged with the plurality of saw tooth members, the pin configured to incrementally rotate the stem clockwise in intermittent contact with the saw tooth members and the rotatable section of the cam assembly during vertical translation of the stem through water pressure force, and slidably rotate the rotatable section of the cam assembly from its first extent to its second extent;

wherein the cam assembly is configured to automatically reverse the incremental rotation of the stem to counterclockwise when the rotatable section of the cam assembly is rotated to its second extent.

2. The swimming pool cleaning head assembly of claim 1, wherein the upper section and the lower section of the cam assembly are coupled in a positionally fixed manner such that they do not rotate with respect to each other.

3. The swimming pool cleaning head assembly of claim 2, wherein the upper section and the lower section of the cam assembly are coupled in a positionally fixed manner through a locking ring comprising a plurality of lugs mechanically engaged with the cam housing.

4. The swimming pool cleaning head assembly of claim 3, wherein the locking ring further comprises an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction.

5. The swimming pool cleaning head assembly of claim 3, further comprising a cap ring removably coupled to the cam housing over the locking ring, the cam housing further comprising a locking arm extending from a side of the cam housing, flexibly engaging the cap ring and resisting rotational movement of the cap ring in one direction.

6. The swimming pool cleaning head assembly of claim 1, further comprising a plurality of ridges on an annular surface of the cam housing, the lower section of the cam assembly comprising a plurality of mating grooves on an annular surface of the lower section of the cam assembly, wherein coupling the plurality of ridges of the cam housing with the plurality of grooves of the cam assembly resists rotational movement of the cam assembly within the cam housing.

7. A swimming pool cleaning head assembly comprising:

a cam housing comprising a cam assembly within the cam housing, the cam assembly comprising an upper cam portion with a first plurality of pin guides, a lower cam portion with a second plurality of pin guides, the upper cam portion and the lower cam portion coupled together in a fixed positional relationship, and a slidably rotatable portion at least part of which is positioned between the upper cam portion and the lower cam portion, the slidably rotatable portion comprising a third plurality of pin guides slidably mounted between the first plurality of pin guides and the second plurality of pin guides, the slidably rotatable portion slidable from a first extent to a second extent; and a stem extending through the cam assembly, the stem comprising a pin slidably engaged with the cam assembly between the first plurality of pin guides and the second plurality of pin guides;

wherein rotation of the slidably rotatable portion alters a pin path through the first and second pluralities of pin guides and rotation of the slidably rotatable portion from the first extent to the second extent reverses a direction of travel for the pin along the pin path through the first and second pluralities of pin guides.

8. The swimming pool cleaning assembly of claim 7, wherein the first and second pluralities of pin guides comprise first and second pluralities of saw tooth members.

9. The swimming pool cleaning assembly of claim 7, wherein the pin is configured to incrementally rotate the stem clockwise in intermittent contact with the pin guides and the slidably rotatable section of the cam assembly during vertical translation of the stem through water pressure force applied to the stem, and slidably rotate the rotatable section of the cam assembly from its first extent to its second extent.

10. The swimming pool cleaning assembly of claim 7, further comprising a plurality of ridges on an annular surface of the cam housing and a plurality of grooves on an annular surface of the cam assembly that mate with the plurality of ridges on the cam housing when removably coupled thereto and resist rotational movement of the cam assembly within the cam housing; wherein the cam assembly is configured to both incrementally rotate the stem clockwise as the stem extends from the housing under water pressure force and to automatically reverse the incremental rotation of the stem counterclockwise.

11. The swimming pool cleaning head assembly of claim 7, further comprising a cap ring removably coupled to the cam housing over a locking ring engaged with the cam housing, the cam housing further comprising a locking arm extending from a side of the cam housing, flexibly engaging the cap ring and preventing rotational movement of the cap ring in one direction.

12. The swimming pool cleaning head assembly of claim 7, further comprising a locking ring mechanically engaged with the cam housing, the locking ring further comprising an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction.

13. A swimming pool cleaning head comprising:

a cleaning head assembly having a housing comprising a cam assembly having an upper section, a lower section, and a slidable section rotatably disposed between the upper section and the lower section, and a stem comprising an outlet configured to eject an intermittent stream of water under water therethrough under water pressure force, the stem extending through the cam assembly, the stem comprising at least one pin slidably engaged within the cam assembly.

14. The swimming pool cleaning head of claim 13, wherein the pin is configured to intermittently engage with a saw tooth member comprised within the upper section and slidable section and to slidably rotate the slidable section while the stem is under water pressure force.

15. The swimming pool cleaning head of claim 13, wherein the slidable section comprises a channel in communication with an angled channel comprised in the upper section, and the slidable section is configured to accommodate through slidable rotation, the pin, as it enters the channel.

16. The swimming pool cleaning head assembly of claim 13, further comprising a locking ring mechanically engaged with the cam housing, the locking ring further comprising an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction.

17. The swimming pool cleaning assembly of claim 13, further comprising a plurality of ridges on an annular surface of the cam housing and a plurality of grooves on an annular surface of the cam assembly that mate with the plurality of ridges on the cam housing when removably coupled thereto and resist rotational movement of the cam assembly within the cam housing; wherein the cam assembly is configured to both incrementally rotate the stem clockwise as the stem extends from the housing under water pressure force and to automatically reverse the incremental rotation of the stem counterclockwise.

18. The swimming pool cleaning head assembly of claim 13, further comprising a cap ring removably coupled to the cam housing over a locking ring engaged with the cam housing, the cam housing further comprising a locking arm extending from a side of the cam housing, flexibly engaging the cap ring and preventing rotational movement of the cap ring in one direction.

* * * * *